US006945007B2

(12) United States Patent
Kobayashi et al.

(10) Patent No.: US 6,945,007 B2
(45) Date of Patent: Sep. 20, 2005

(54) METHOD OF PATTERNING, INSTALLING, RENEWING AND/OR RECYCLING CARPET TILES

(75) Inventors: Seiin Kobayashi, Yonezawa (JP); Thomas D. Nord, Newnan, GA (US); Akihito Suzuki, Kawanishi-machi (JP)

(73) Assignee: Milliken & Company, Spartanburg, SC (US)

( * ) Notice: Subject to any disclaimer, the term of this patent is extended or adjusted under 35 U.S.C. 154(b) by 21 days.

(21) Appl. No.: 09/934,373

(22) Filed: Aug. 21, 2001

(65) Prior Publication Data

US 2003/0037508 A1 Feb. 27, 2003

(51) Int. Cl.[7] ..... E04D 15/00; E04F 21/00; E04G 21/14

(52) U.S. Cl. ..... 52/749.11; 156/250; 68/28

(58) Field of Search ..... 156/250, 94; 52/749.11, 52/387; 8/150; 68/28, 200, 205

(56) References Cited

U.S. PATENT DOCUMENTS

| | | | | |
|---|---|---|---|---|
| 1,885,464 A | | 11/1932 | Miller | |
| 2,729,536 A | | 1/1956 | Pull et al. | 8/149.3 |
| 2,986,149 A | | 5/1961 | Brakel | 134/64 |
| 3,046,774 A | | 7/1962 | Glock | 68/39 |
| 3,333,291 A | | 8/1967 | Hondzinski | 15/302 |
| 3,396,422 A | | 8/1968 | Haverberg | 15/308 |
| 3,574,526 A | | 4/1971 | Bell | 8/149.1 |
| 3,902,452 A | | 9/1975 | Queen et al. | 118/66 |
| 4,103,389 A | | 8/1978 | Resnick et al. | 15/302 |
| 4,268,929 A | | 5/1981 | Sorensen et al. | 8/151 |
| 4,522,857 A | | 6/1985 | Higgins | 428/95 |
| 4,872,930 A | * | 10/1989 | Kajikawa et al. | 156/72 |
| 5,380,561 A | | 1/1995 | Dorn | 427/430.1 |
| 5,381,592 A | | 1/1995 | Higgins | 28/100 |
| 5,457,845 A | | 10/1995 | Higgins et al. | 15/302 |
| 5,540,968 A | | 7/1996 | Higgins | 428/95 |
| 5,545,276 A | | 8/1996 | Higgins | 156/79 |
| 5,658,430 A | * | 8/1997 | Drake et al. | 156/71 |
| 5,763,001 A | | 6/1998 | Brown | 427/140 |
| 5,948,500 A | | 9/1999 | Higgins | 428/95 |
| 6,203,881 B1 | | 3/2001 | Higgins | 428/95 |
| 6,507,285 B2 | * | 1/2003 | Blum et al. | 340/815.4 |
| 6,524,107 B1 | * | 2/2003 | Brown | 434/72 |
| 2002/0031636 A1 | * | 3/2002 | Brown et al. | 428/95 |
| 2002/0074075 A1 | * | 6/2002 | Brown et al. | 156/94 |

FOREIGN PATENT DOCUMENTS

| | | |
|---|---|---|
| DE | 3429 049 | 2/1986 |
| DE | 200 04 811 | 5/2000 |
| JP | 01224067 | 9/1989 |
| JP | 09078443 | 3/1997 |

* cited by examiner

*Primary Examiner*—Naoko Slack
*Assistant Examiner*—Chi Q. Nguyen
(74) *Attorney, Agent, or Firm*—Terry T. Moyer; Daniel R. Alexander

(57) ABSTRACT

Renewing, washing, and/or recycling of used carpet tiles is provided. In accordance with one embodiment, carpet tiles are purchased or leased and installed with adjacent tiles being of a different pattern, design, color, shade, and/or the like so that no two identical tiles abut one another. This method of patterning and installing carpet tiles can eliminate the need for shade sorting and site mapping. Also, this method permits the ability to replace one or more damaged or severely stained tiles with new or renewed tiles and without worrying about tile-to-tile shading. The renewed carpet tiles are washed with a high-pressure fluid, and entangling of piles is removed and piles raised.

12 Claims, 11 Drawing Sheets

36 ORIGINAL PATTERNS AND COLORS

Two sets of tile are manufactured for one installation.
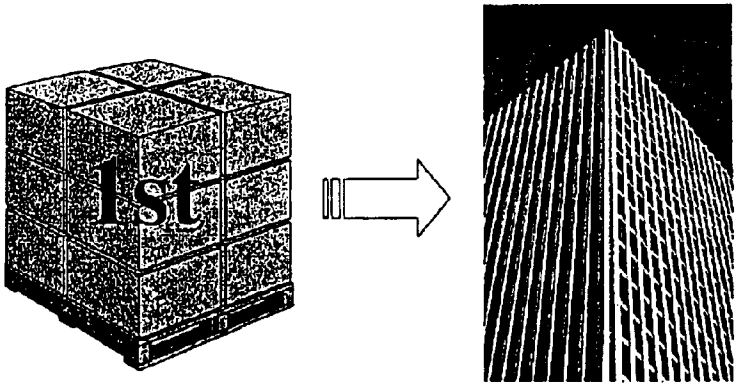
ONE COMPLETE SET TO INSTALLATION
*FIG. —4A—*
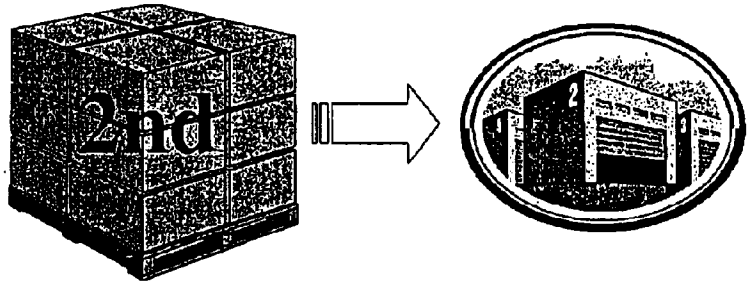
THE SECOND SET TO WAREHOUSE
*FIG. —4B—*

Before washing a "map" of the installation must be made.
After washing, tile must be replaced in its original location because of differences in wear and soiling over time.
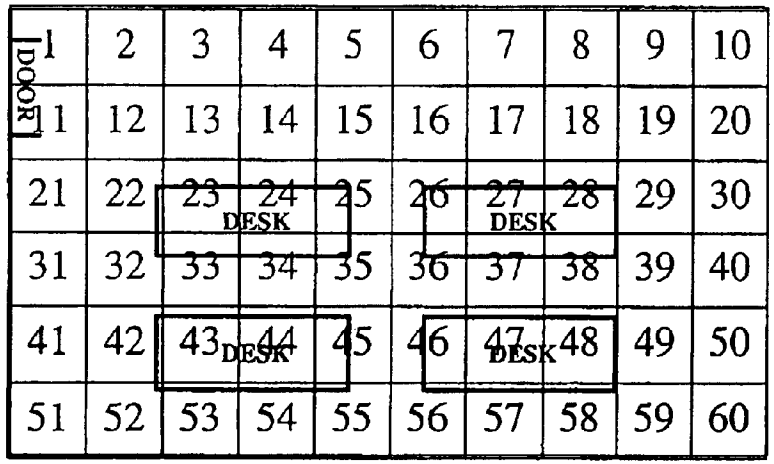
INSTALLATION MAP TO MARK POSITION OF EACH TILE
*FIG. –5A–*
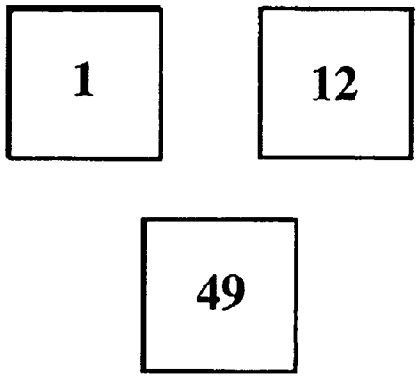
ALL TILE MUST BE NUMBERED ON THE BACK
*FIG. –5B–*

After mapping the installation, the first set of tile is taken up, is then washed and placed in storage until it is needed again.

The second set of tile is installed in its place. The cycle begins again.

FIG. —9—

METHOD OF PATTERNING, INSTALLING, RENEWING AND/OR RECYCLING CARPET TILES

FIELD OF THE INVENTION

The present invention relates to a method or methods of patterning, installing, renewing and/or recycling carpet tiles or carpet pieces and products produced by such methods, new patterning methods for renewable (recyclable) carpet tiles or products, patterning methods for carpet tiles that allow efficient and less expensive renewal thereof, leasing of renewable carpet tile or products, and the like.

BACKGROUND OF THE INVENTION

In general, carpet tiles conventionally used at various places such as shops and offices are cleaned on a periodic basis. As years go by, however, the carpet tiles become dirty due to mud, sand, dust, dropped or spilled drink and food, resulting in non-uniform colors and stains. In such cases, the old carpet tiles are, as a rule, replaced with new ones, and the former are discarded.

Such replacement of carpet tiles incurs high cost. Not only the cost of new carpet tiles, but also the cost of removal and disposal of the used carpet tiles. Recently, municipalities have added heavy charges for land filling of used carpet tiles.

Also, destructive recycling by, for example, grinding synthetic fiber carpet tile into small chips and using the chips as either fuel, fill, or to be re-extruded as fiber is costly and does not maximize the inherent value of the used carpet tile. Further, the disposal of used carpet tiles by incineration has recently become an environmental concern.

Many end users of modular carpet tile flooring are beginning to see the need for a recyclable or renewable product. Overall environmental awareness is increasing, as is pressure on reducing waste volume and cost to landfill. Companies which use thousands of square yards of carpet tile flooring are feeling pressure from within their companies, from their governments, and from the general public to use a product which is more "environmentally friendly". Every year over 20,000,000 square yards of carpet tile is produced and sold in Japan alone.

The currently known processes of recycling or renewing (cleaning, retexturing) carpet tile flooring have limitations, problems or drawbacks including complexity and cost. First, completely destructively recycling carpet tile requires complex and expensive machinery and processes to separate, filter, and clean components before they are reused. Not all of these components are suitable for reuse by themselves. Many have to be combined with new material in order to create a good quality end product. This reduces the "effective" percentage of recycled materials that are ultimately used in the new product. Second, renewing conventionally patterned tile carpet, which is more often than not of only one pattern and/or color in an installation, requires complex sorting and handling work both before renewing and after renewing.

In the case of leased tile, two sets of carpet tile must be manufactured for one installation. One complete set is installed and another complete set is kept in storage. After a period of time, when the tile on the floor needs to be renewed, a "map" of the installation must be made and each tile must be manually numbered on the back as it is taken up. The map and numbering is used so that when the tile is replaced at a later date, it will be placed in the exact same place from where it was taken up. The tile must be replaced in the exact same place as it was taken up because the shade difference between tiles from different areas of the installation (from difference in wear and soiling over time) may produce an undesirable effect if they were to be placed next to each other. After peeling or taking up the first installation, the second set of tile is installed. The first set is then renewed and placed in storage until it is needed again. Thus in the case of leased tile, there are costs for handling, storage of tile, extra investment in the second set of tile, and renewal cost among others to be considered.

In the case of purchased or owned tile carpet that is to be renewed, sorting and handling is also complex. As described in U.S. Provisional Patent Application Ser. No. 60/223,450, filed on Aug. 4, 2000, before renewing, damaged or unusable tile must be manually culled out. Then the tile must be manually sorted into lots according to the degree of wear and soiling of each tile. After renewal, a tile that has experienced a higher degree of wear and/or soiling cannot be installed next to a tile with lesser degree of wear and soiling because of the difference in shading between the tiles. Therefore, pre-sorting before renewal is required and tile must be placed into different lots that contain tile of approximately the same shade. After the renewal process, the tile must be sorted into lots again because of differences in shade caused by the renewal process itself. Because of the different lots of tile that are generated during the entire renewal process, the installation which is to receive the renewed carpet must be carefully mapped out so that different lots are not installed next to each other resulting in shade differences. This type of renewal process can lead to having an inventory with many different lots (shades) of renewed tile that cannot be easily placed into an installation and/or very small lots that cannot be sold. Thus in the case of renewing purchased or owned tile carpet, there are costs for manually sorting both before and after renewal, cost of keeping inventory, and renewal cost among others to be considered.

Hence, there is a need for an improved method or process of patterning, installing, renewing, and/or recycling carpet tiles and the like.

SUMMARY OF THE INVENTION

The present invention has been made in order to solve or at least address the above limitations, problems or drawbacks of other carpet renewal processes, and at least one object is to provide an improved method of refurbishing or renewing carpet tiles, and of non-destructively recycling carpet tiles. At least one method of the present invention provides for the non-destructive recycling of used carpet tiles one or more times before they must be discarded or destructively recycled.

The invention is directed to the use of a renewable patterned carpet that can be used new then renewed at least one time, but ideally could be renewed an additional three times, and would have the advantage over other products by keeping processing, handling, and inventory costs low. The invention is also directed to a renewable product which improves the supplier's self-image, makes the end user feel good about the product he/she is using, and helps the environment by reducing landfill and incineration volumes.

In accordance with at least one preferred embodiment, the carpet tile is patterned and installed in such a way to eliminate the cost of manually shade sorting tile before and after renewal. Each individual tile has one of a number of different patterns/colors (see FIG. 1A). The tiles are installed randomly with no tile of the same pattern/color installed adjacently (see FIG. 1B). After renewal, because each tile has a different pattern/color and will not have the same pattern/color tile installed adjacently, there is no need for shade sorting the tile into different lots of the same shade so that each installed tile matches the adjacent tile.

It is preferred that the carpet tiles of the present invention have at least 2 different pattern/color combinations, ideally 36 or more different pattern/color combinations. The patterns on the surface of the tile can be the result of patterning processes including, but not limited to graphic tufting, screen printing, pattern transfer, atmospheric dyeing, injection dyeing, or combinations thereof.

The invention is not limited by the types of patterns that can be on the surface of the tile. These patterns can be made up, but is not limited to, any geometric shape, lines, shading, gradation, or combinations thereof. The most preferable type of surface pattern for the tiles of the present invention is a gradation of color and shade. Gradation of color and shade has the advantage of being able to hide soiling when compared to most other surface patterns.

The nature of the present invention allows for many different color combinations contained in the overall carpet patterning. These color combinations may contain both cool and warm colors alike and of various shades. The advantage of having a large range of color combinations is that the tiles are more likely to coordinate with desks, chairs, partitions, etc. within the installation. Conventionally patterned carpet tile is more limited to what it matches, and many individual patterns and colors might have to be stocked to service the variation of demand within the market. The advantage of the present invention is that the initially set-up pattern and color offering has a better chance to coordinate with the installation without the complexity of having to develop new patterns and colors.

The carpet tiles of the present invention may include a pile face or fabric whose pile yarn contains, but is not limited to natural or synthetic fibers or blends such as nylon, polyester, acrylic, cotton, wool, rayon, polypropylene, or any combination thereof. Fibers used in the invention, such as in multifilament yarn or monofilament yarn, can have a range of about 0.1 to 400 dpf, preferably from about 1 to 50 dpf. The fiber used in the pile yarn can be non-dyed, space dyed, solution dyed, atmospherically dyed, pressure dyed, yarn dyed, etc. The carpet tiles of the present invention may include a pile face or fabric whose pile yarn construction can be made up of fiber that is monofilament, multifilament, staple in nature, or any combination thereof. In addition this monofilament, multifilament, staple yarn, or combination can be twisted, non-twisted (zero-twist), spun, blended, air entangled, heat-set, non-heat-set, or any combination thereof.

The carpet tiles of the present invention may include a pile face or surface fabric that is composed of, but is not limited to, tufted cut-pile fabric, tufted loop-pile fabric, bonded cut-pile fabric, needle punched fabric, woven fabric, knit fabric, non-woven, or combinations thereof.

The carpet tiles of the present invention may include a pile face or surface fabric with a fabric substrate or backing made of woven or non-woven material that can be made of, but is not limited to, polyester, polypropylene, nylon, acrylic, cotton, or combinations thereof.

The carpet tiles of the present invention may include hard back or cushion back tile whose backing contains, but is not limited to, PVC, thermoplastic, latex, glass, rubber, urethane, felt, foam, or combinations thereof.

The carpet tiles of the present invention can be renewed with a process which cleans the tile removing soil and stains with a process utilizing, but not limited to water, detergent, solvents, air or a combination thereof. More specifically, the renewal process of the present invention can utilize the forced movement of air, water or other liquids, solutions or chemicals to remove soil and stains and retexture the pile. The renewal process of the present invention can include the process of patterning, printing, coloring, or re-patterning the carpet tile with patterning processes including, but not limited to screen printing, pattern transfer, atmospheric dyeing, injection dyeing, pad dyeing, flood dyeing, resist dyeing, or combinations thereof.

One object of the invention is a renewable patterned carpet that can be installed new, used and then renewed at least one time, but ideally could be renewed one or more additional times, and would have the advantage over other renewed products by keeping processing, handling, and inventory costs low. See FIGS. 2A and 2B to understand the possible complexities of the renewal cycle of other patterned tile carpet. See FIG. 3 to understand the less complex renewal process or cycle of the present invention. Another object of the invention is a renewable product which helps the environment by reducing the volume of tile carpet going to landfill or incineration.

Another object of the invention is to reduce the cost of making new tile for each successive installation. The cost of renewal is much less than the cost of making new tile carpet with respect to labor, raw materials, and energy.

Another purpose of the present invention is to satisfy the market appeal for a product that can be renewed and used several times. Overall environmental awareness is increasing, as is pressure on reducing waste volume and cost to landfill. Companies which use thousands of square yards of carpet tile flooring are feeling pressure from within their companies, from their governments, and from the general public to use a product which is more "environmentally friendly".

At least one embodiment of the present invention addresses the limitation of manually shade sorting tile before and after renewal. This is accomplished by utilizing the distinct method of patterning and installation of the invention. Each individual tile is patterned with one of a number of different patterns/colors. The invention is intentionally designed not to have the same pattern/color repeated on each and every tile. After renewal, conventional tiles without the exact same shade installed adjacently will result in an undesirable installation because of tile-to-tile shading. The carpet tile of the present invention is preferably installed randomly with no tile of the same pattern installed adjacently. After renewal, because each tile has a different pattern/color and will not have the same pattern/color tile installed adjacently, there is no need for shade sorting the tile into different lots of the same shade so that each installed tile matches the adjacent tile.

Another limitation that is addressed by at least one embodiment of the invention is that the labor and time required to map and plan installations after each renewal pass, with respect to opportunities encountered with tile-to-tile shading, will be eliminated. Renewed carpet tile will simply be taken out of the box and installed. The carpet tiles of the present invention that come from different areas of the same installation site or that come from different installation sites altogether can be combined into a single generational lot after renewal. For example, there is one large first generation tile lot after the first renewal, one large second generation tile lot after the second renewal, etc. No matter where the invention was first installed when new, upon each renewal it can be placed together into the next generational lot. It can then be installed into the next installation, regardless of installation size. The patterning and random installation of the invention provide for this to be accomplished.

Since the nature of at least one embodiment of the present invention eliminates shade sorting which creates many different lots of tile, the number of lots in inventory is minimized. Orders can be serviced from a few large generational lots of inventory. Small lots that tend to accumulate and stagnate in inventory are eliminated. Inventory can be turned over quickly. Thus, inventory costs will be held to a minimum.

At lest one embodiment of the present invention eliminates the need to manufacture and hold a second inventory of tile for an installation in situations where the carpet tile is a leased product. The tile will simply be replaced with renewed product because the second installation will not have to exactly match the first installation, nor is it expected to.

The present invention also permits the ability to replace a damaged or severely stained tile without having to worry about tile-to-tile shading. With conventionally patterned tile, where all tiles are the same pattern and/or color, if a damaged tile is replaced with a new tile from stock, it may or may not match the older tiles adjacent to it because the older tiles have experienced wear and soiling. With the present invention, after time if one tile happens to get damaged or severely stained, the tile can be replaced with a new or renewed tile without having to worry about tile-to-tile shading since the installation is random and the new tile is not placed next to a tile with the same pattern.

The present invention also helps solve the environmental consequences and implications of disposing by landfill or incineration of hundreds of thousands of square yards of carpet tile annually. The carpet time of the present invention will preferably be renewed and reused at least one time, ideally two or more times, after the original use when new.

Selected advantages of the present invention include:

A tile carpet product that can be renewed and reused.

Renewed tile carpet is as attractive as new tile.

Eliminates manual shade sorting of tile before and after renewal when compared to the renewal cycle of conventionally patterned carpet.

Eliminates mapping and planning of installations after renewal with respect to opportunities with tile-to-tile shading.

Allows for a larger range of color content that allows easier coordination with installation desks, chairs, partitions, etc.

Allows replacement of a damaged or severely stained old tile with a new or renewed tile without having tile-to-tile shading problems.

Minimizes inventory costs when compared to the renewal cycle of conventionally patterned carpet.

Carpet tile can be leased, rented, or sold.

Renewal is an advantageous alternative to costly and less efficient recycling.

When leasing the carpet tile as opposed to owning, the end user can use the carpet tile as a business expense rather than an owned asset that may carry a tax liability.

Overall cost of the renewed carpet tile is much less than the cost of manufacturing new carpet tile for the same installation.

Reduces overall waste volume to landfill or incinerators.

In accordance with one embodiment of the method of the present invention, the process includes the steps of removing, refurbishing (renewing), repatterning, and reinstalling (replacing) used carpet tiles or carpet pieces or sections.

According to one aspect of the invention, there is provided a method of reproducing/recoloring carpet tiles, characterized by:

a washing/reproducing step of jetting a fluid onto used carpet tiles, thereby to perform cleaning for cleaning dirt and/or stain on the used carpet tiles and to perform retexturing, thus forming reproduced carpet tiles;

and an optional recoloring (or patterning) step of recoloring one or more of the reproduced carpet tiles with a pattern, design, shade or color.

With this method, the used carpet tiles can be cleaned by washing, entangling of piles removed, piles are raised, and may be sheared and reproduced carpet tiles produced. In addition, the surface of the reproduced carpet tile may be treated or recolored and thus made to look like a new tile.

The retexturing of the present invention means removal of entangling of piles and raising of piles (and may include shearing, vacuuming, and brushing).

According to another aspect of the invention, there is provided a method of reproducing/recoloring carpet tiles, characterized by:

a recovery step of recovering carpet tiles in use;

a first choosing step of choosing the recovered carpet tiles according to the condition of use;

a washing/reproducing step of performing cleaning for cleaning dirt, grit, and/or stain on the recovered carpet tiles, and performing retexturing, thus forming reproduced carpet tiles;

a recoloring step of recoloring at least some of the reproduced carpet tiles using a printing, dyeing, or coloring machine;

and installing the reproduced and/or recolored carpet tiles in a random fashion to avoid having similar tiles adjacent one another.

With this method, the carpet tiles in use are recovered and may be subjected to an initial choosing (or elimination) step. Thus, carpet tiles which are difficult to reproduce, refurbish, renew, etc. and recolor can be eliminated or categorized prior to washing. Essentially, this choosing step can be described as sorting out tiles that can not be reused due to physical damage or defects, for example, cuts, holes, torn carpet, separated backing, or small pieces cut to match or fit to a room.

According to still another aspect of the invention, the method may further include a step of decoloring the reproduced carpet tiles between the washing/reproducing step and the recoloring step. With this method, all or part of the original color or pattern may be removed.

According to still another aspect of the invention, the method further includes, between the washing/reproducing step and the recoloring step, a step of coating the reproduced carpet tiles with at least one of a chemical agent with a water-repellent effect and a chemical agent with a coloring agent diffusion prevention effect, which enhances clearness of surfaces of the reproduced carpet tiles. With this method, the treatment with the design or color can be made easier and have better uniformity.

According to still another aspect of the invention, the method further includes a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect. The surface treatment step being carried out prior to, during or following the recoloring step or one of steps following the recoloring step. With this method, the surfaces of reproduced carpet tiles can be protected against stains, static electricity or propagation of germs.

According to still another aspect of the invention, the method further includes a bending step of bending the curved reproduced carpet tiles to the original shape, prior to or in the washing/reproducing step or any of the steps following the washing/reproducing step. With this method, the carpet tile curved in the reproducing step can be substantially flattened.

According to still another aspect of the invention, the method further includes a cutting or trimming step of cutting out or trimming off edge portions of the reproduced tiles, where piles have fallen, which are left after completion of the above steps, the cutting step being performed prior to or in the washing/reproducing step or any one of the steps following the washing/reproducing step. With this method, entangling of piles can be removed, seamability can be improved, design or pattern registration can be improved, and an undesirable external appearance of the carpet tile is improved.

According to another aspect of the invention, the method further includes a shearing, vacuuming and/or brushing step of shearing the top of the pile, vacuuming the pile and/or brushing the pile to create a constant height pile and/or an upright pile preferably prior to the recoloring step and following the washing step.

According to another aspect of the present invention, the method further includes a back coating step of coating the back of the carpet tile with a thin layer of a sealant and/or a cushion layer. It is preferred to back coat following washing/reproducing and recoloring.

According to still another aspect of the present invention, there is provided a method of maximizing the inherent value in used carpet tile by non-destructively recycling used carpet tiles (washing/reproducing, recoloring, etc.). In one embodiment, reproduced/recolored carpet tile are inventoried for sale as reproduced, renewed, refurbished, or recycled carpet tiles. In another embodiment, these renewed, refurbished, recycled carpet tiles are donated to charity, public institutions, schools, etc. In yet another embodiment, renewed, refurbished, or recycled carpet tiles are created from used carpet tiles from a selected company or location and are sold back to or installed back in that same company or location. In still another embodiment, used carpet tiles are washed/reproduced and inventoried, then when an order for reproduced/recolored carpet tiles is made, the inventoried washed/reproduced carpet tiles are recolored and shipped. In still yet another embodiment, used carpet tiles are inventoried, then when an order for reproduced/recolored carpet tile is made, the inventoried used carpet tiles are washed/reproduced, recolored, and shipped.

In accordance with another aspect of the present invention, there is provided a method of providing or marketing carpet tile by offering new carpet tiles and/or reproduced/recolored carpet tiles. Presumably, reproduced/recolored (recycled) carpet tile would be offered at a lower price than new carpet tile of the same grade and quality. Price blending of the higher priced new carpet tiles and lower priced reproduced/recolored carpet tiles can reduce the total cost of a carpet tile project or sale. The cost of renewed or reproduced carpet is less than that of buying new carpet and land filling the used carpet even if the sale price of renewed carpet is more per square yard or meter than new carpet due to the disposal costs of used carpet.

In accordance with another aspect of the present invention, there is provided a method of providing and marketing extended life, renewable carpet tile by leasing the tile or by selling the tile where the carpet tile is installed, used, taken up, reproduced/renewed/cleaned, reinstalled, used, taken up, reproduced/renewed/cleaned, reinstalled, used, taken up, reproduced/renewed/cleaned, reinstalled, used, etc. Following two or more generations of use, the carpet tile may be discarded or destructively recycled. For example, new carpet tile may be sold as 15–30 year carpet tile which can be sold new and reproduced/renewed/cleaned two or more times. Each time the carpet tile is reproduced/renewed/cleaned, it can be colored, patterned, designed, etc. to give it a new look which is appropriate for that time frame so the reproduced/renewed/cleaned carpet tile is like new carpet tile of that time period (fresh, new look). Hence, 30 year old carpet tile would not look 10, 20, or 30 years old.

In accordance with another aspect of the invention, there is provided a method or service of collecting used leased or purchased carpet tiles, reproducing/renewing/cleaning the collected used carpet tiles, and selling or leasing the reproduced/renewed/cleaned carpet tiles. This substantially reduces or eliminates the land filling or incineration charges for discarding or disposing of used carpet tiles. Also, although it is not preferred, used leased or purchased carpet tiles can be collected, washed, and sold as washed used carpet tiles or as seconds. Also, a first business can collect used leased or purchased carpet tiles, a second business wash the collected used carpet tiles, and a third business reproduce/renew/recolor/sell or lease the washed carpet tiles, etc.

According to still another aspect of the invention, there is provided a method of recycling carpet tiles in a plurality of division areas, in each of which a plurality of carpet tiles are laid, the method including the steps of: removing carpet tiles in a first division area, which are to be first reproduced; laying new, auxiliary or renewed carpet tiles on the first division area from which the carpet tiles have been removed; reproducing the removed carpet tiles; removing carpet tiles in a second division area, which are to be subsequently reproduced; and successively laying the first removed and reproduced carpet tiles on the second division area from which the carpet titles were removed; and the like.

With this method, new, auxiliary or reproduced carpet tiles are laid on a division area from which carpet tiles have been removed. Removed and reproduced carpet tiles from a selected division can be laid back on that same division area if they provide time to remove, wash/reproduce/recolor, and reinstall.

BRIEF DESCRIPTION OF THE SEVERAL VIEWS OF THE DRAWING

FIG. 1A is a schematic top view illustration of 36 original different patterns/designs/colors/shades (36 original different tiles).

FIG. 1B is a schematic top view illustration of a plurality of the 36 original different individual patterns/designs/colors/shades (different tiles) randomly installed at a job site.

FIG. 2A is a schematic flow diagram including the steps of installation, use, removal, shade sorting before renewal, and renewal leading to shade differences in the renewed tiles.

FIG. 2B is a schematic flow diagram including the steps of shade sorting after renewal, installation of different lots, and left over inventory.

FIGS. 4A, 4B, 5A, 5B, 6A, and 6B relate to a leased carpet tile washing process.

FIGS. 4A and 4B are respective schematic representations of two sets of tile manufactured for one installation (one installed, the other stored).

FIG. 5A is a schematic top view representation of an installation map for marking the position of each carpet tile.

FIG. 5B is a schematic bottom view illustration of selected removed tiles each with their respective map number thereon.

FIGS. 6A and 6B are respective illustrations of the first set being washed and stored after being mapped and numbered, and the second set being taken from storage and installed.

DETAILED DESCRIPTION OF THE INVENTION

Figures 1A, 1B:
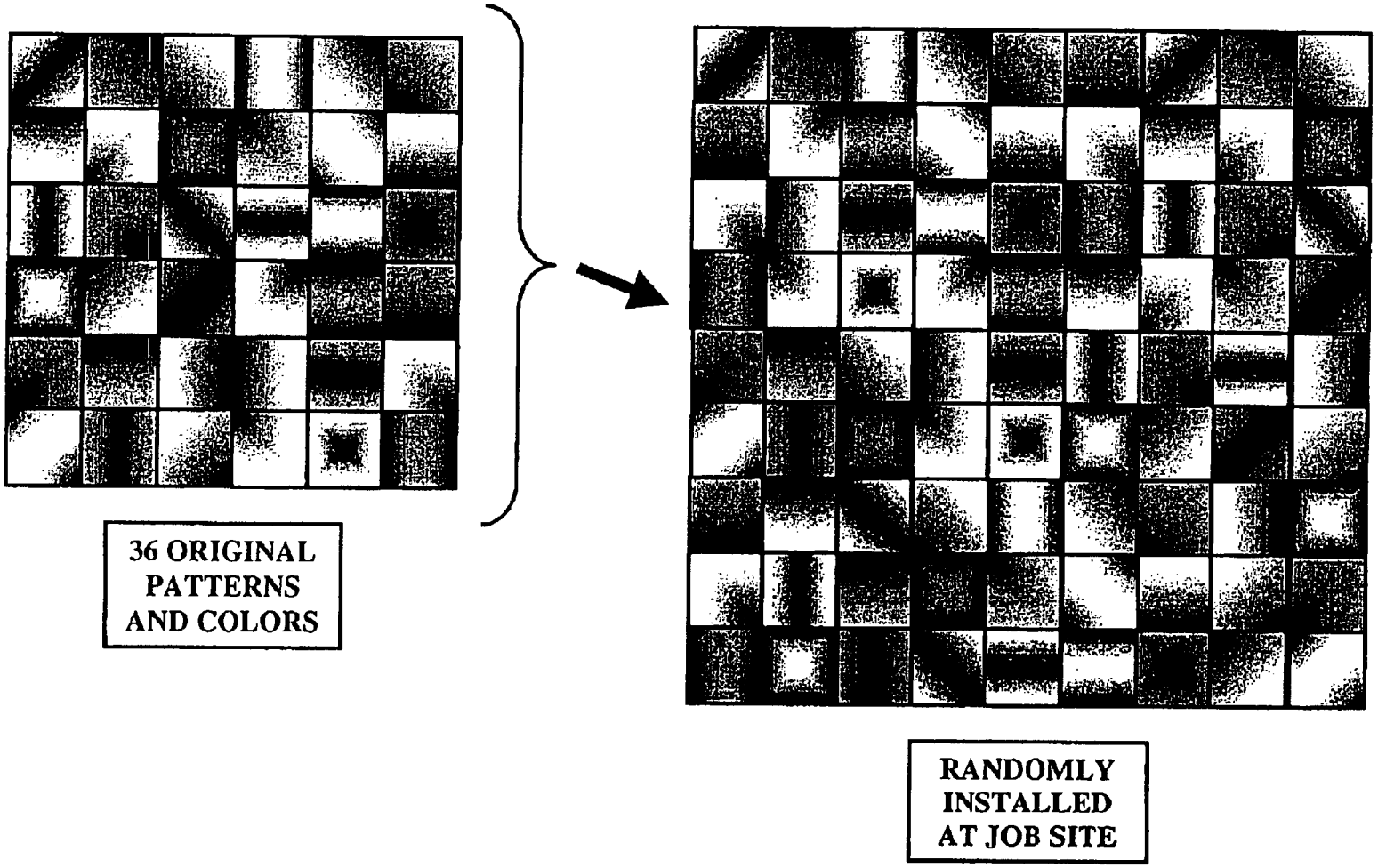
FIGS. 1A and 1B relate to an example of how the individual pattern/design/color/shade combinations of an exemplary embodiment of the present invention are installed randomly at a job site.

Exemplary methods or processes and products made thereby according to aspects or embodiments of the present invention will now be described with reference to the accompanying drawings.

In accordance with at least one embodiment of the present invention, the drawbacks, complexities, and waste of prior or other carpet tile renewal or refurbishment processes or methods are addressed, eliminated or at least reduced by having an assortment of two or more, preferably four or more, more preferably nine or more, and most preferably thirty-six or more, different carpet tile patterns, colors, designs, shades, and/or the like provided as an original assortment of carpet tiles which are randomly installed at a job site so that no two identical tiles are adjacent one another, and more preferably randomly installed without any reoccurring overall design elements which would form bands, streaks, or dark or light patches. Furthermore, individual tiles can be rotated 90°, 180°, or 270° to form a different look and as such enhance the randomness of the patterns at the job site or installation. By having a plurality of patterns, designs, colors, shades, and/or the like and by having a random positioning or location of the different tiles, carpet tiles of the present invention may be more efficiently refurbished, renewed, reproduced, recolored, and/or the like and reused.

In the past, carpet tile renewal required several sorting steps which sorted tiles based on shade or color variation, staining, and the like and limited the use of renewed or refurbished carpet tiles based on shade or color lots or groupings and lead to the discarding of numerous tiles which could not be reused. In accordance with the present invention, ninety percent or more, preferably ninety-five percent or more of the used carpet tiles can be refurbished or renewed, reproduced, recolored, and/or the like and reused or reinstalled because the different patterns and random positioning of the tiles of the different tile patterns hides shade variations, stains, and the like and allows a greater percentage of the tiles to be reused.

Also, the random pattern layout of the present invention provides a novel and unique appearance to the flooring as contrasted to flooring having a single pattern, design, color, shade, or the like. Hence, it is aesthetically pleasing and may be preferred over a single color or pattern look.

Installation of the plurality of patterns of the present invention can be facilitated by having the tiles palletized or boxed in a random order with no two identical patterns, designs, colors, or shades adjacent one another in the box or pallet. In this manner, the installer need only grab the next tile and lay it down in order to produce a monolithic installation of a random assortment of tiles. Also, certain tiles in the stack may be rotated relative to the others so that no only do you have different patterns, colors, shades, or the like, but also, you have a random orientation of these patterns which provides for even a greater number of different appearances to the tiles. This not only tends to hide or camouflage shade variation, stains, and the like, but also eliminates bands, streaks, frostiness, shine, or other effects associated with the pile lay of carpet tile.

With reference to FIGS. 1A and 1B of the drawings, although thirty-six original patterns and colors are schematically shown in FIG. 1A, it is to be understood that the present invention is not limited to thirty-six but is instead directed to any number of different patterns, designs, colors, shades, orientations, and/or the like which can provide for the random appearance to the carpet tile installation or job site Further, it is contemplated that a 36"×36" tile could incorporate four different 18"×18" tile patterns thereon and thereby mimic four different adjacent 18" tile patterns, colors, designs, shades or the like.

Alternatively, each of the tiles with different patterns, designs, colors, shades, or the like when packaged in a different box or on a different pallet, the installers will grab tiles from each box or stack as they install the carpet tile being careful to insure that no two adjacent tiles are exactly alike.

If an installation is made up of a common pattern, design, color or shade, one can renew, refurbish, and recolor the used carpet tile by applying a pattern, design, color, or shade, or the like to each of the washed or cleaned carpet tiles to create the different patterns, colors, designs, or shade of the present invention thereon and install the refurbished and recolored, reprinted or overprinted carpet tiles in the random installation technique of the present invention. Hence, the carpet tile at a particular location need not have been in a random assortment or pattern to be renewed in accordance with the present invention.

Also, with respect to FIGS. 1A and 1B, it is to be understood that the present invention is not limited to the particular patterns shown which are for ease of demonstration only and not limiting.

Further with respect to FIGS. 1A and 1B, these figures illustrate an example of how the individual pattern/color combinations of the invention are installed randomly. Also, note that the number of original patterns and colors is not limited to 36 and note that the invention is not limited to the patterns shown which are for ease of demonstration only.

Figure 2A:
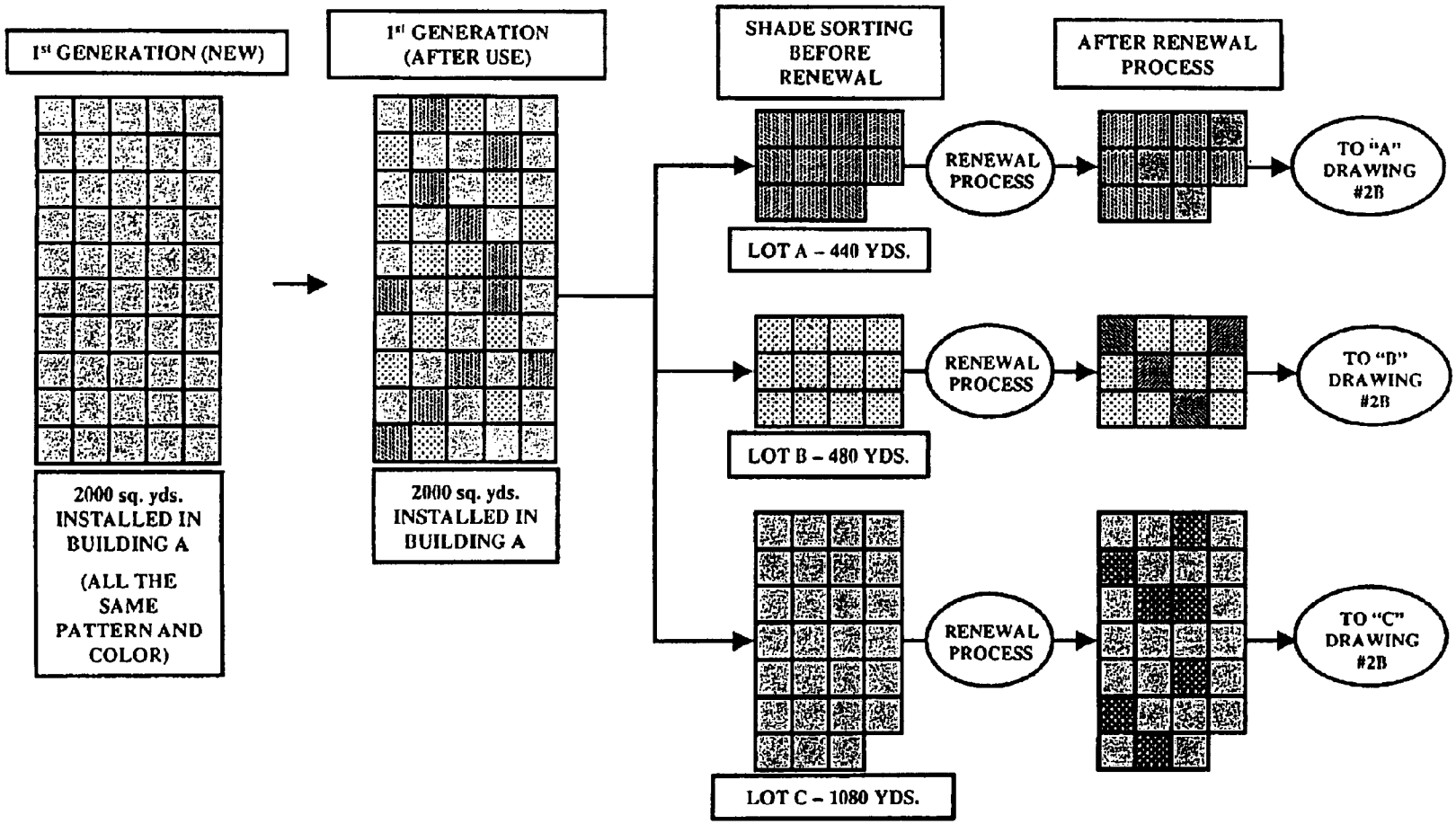
FIGS. 2A and 2B relate to a carpet tile renewal process which can result in many lots which cannot be combined.
Figure 2B:
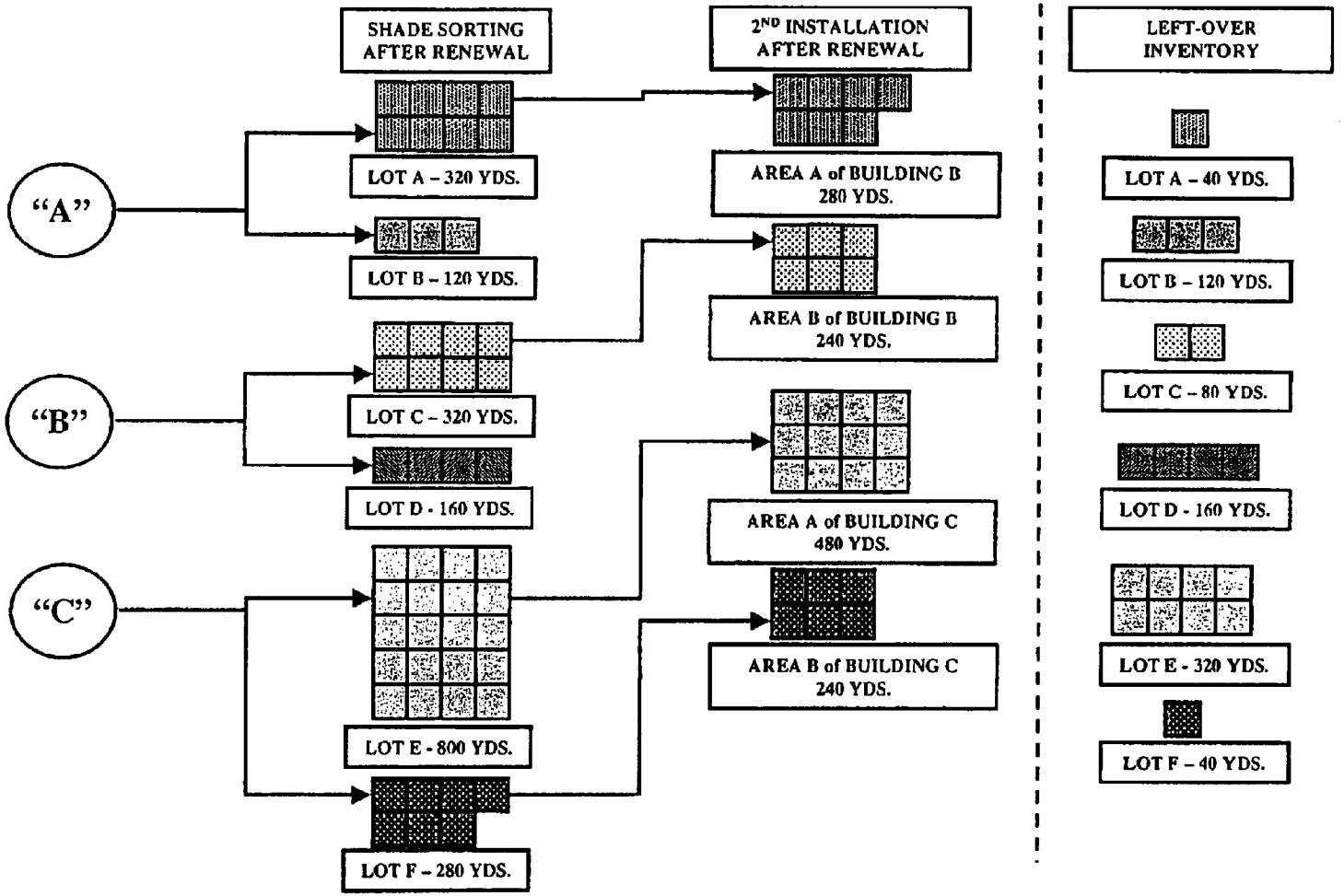

With respect to FIGS. 2A and 2B of the drawings, there is shown a typical carpet tile renewal process wherein in the particular example 2,000 sq. yds. are installed in Building A, after a period of use, the carpet tiles have shade differences due to wear and soil. These tiles are removed and shade sorted prior to being renewed (washed, treated, colored). In the particular example, 440 yards are sorted into Lot A and have a relatively dark shade, 480 yards are sorted into Lot B and have a medium shade, and 1,080 yards are sorted into Lot C and have a light shade. These three different lots are renewed and additional shade differences caused by the renewal process force original Lot A to be sorted into two new lots, A and B, while original Lot B is sorted into two new lots, C and D, and original Lot C is sorted into two new lots, E and F.

In the typical process, these different lots have a sufficient shade variation to prevent them from being combined in a conventional installation having a homogenous pattern, design, color, or shade. Hence, such lots of different shades of renewed carpet tile must be sorted and stored in the hope that the particular quantity of each lot can be used in a particular installation or area of an installation and requires installation to be mapped to best fit the different lots and utilize as many of the different tiles as possible. As shown in FIG. 2B, there is left over inventory which did not fit at the location or the particular mapping of the location. This left over inventory may or may not be sold and may have to be discarded or destructively recycled. Also, this typical renewal process is complicated, cumbersome, and complex due to numerous sorting steps, inventorying of different lots, mapping of locations to try to use different lots, and the like.

Also, with respect to FIGS. 2A and 2B, these figures illustrate the life cycle of conventional tile (all the same pattern and color) from use as a new product through use as a renewed product. Further, with respect to the $1^{st}$ Generation (After Use) of FIG. 2A, note shade differences in tile because of wear and soiling. With respect to the After Renewal Process of FIG. 2A, note shade differences in tile caused by renewal process. With respect to the "A", "B", and "C" of FIG. 2B, note that renewing conventionally patterned tile results in many lots which cannot be combined. With respect to $2^{nd}$ Installation After Renewal of FIG. 2B, note that installations have to be mapped to "best fit" the different lots. Lastly, with respect to Left-Over Inventory of FIG. 2B, note that left over inventory may or may not be sold.

Figure 3:
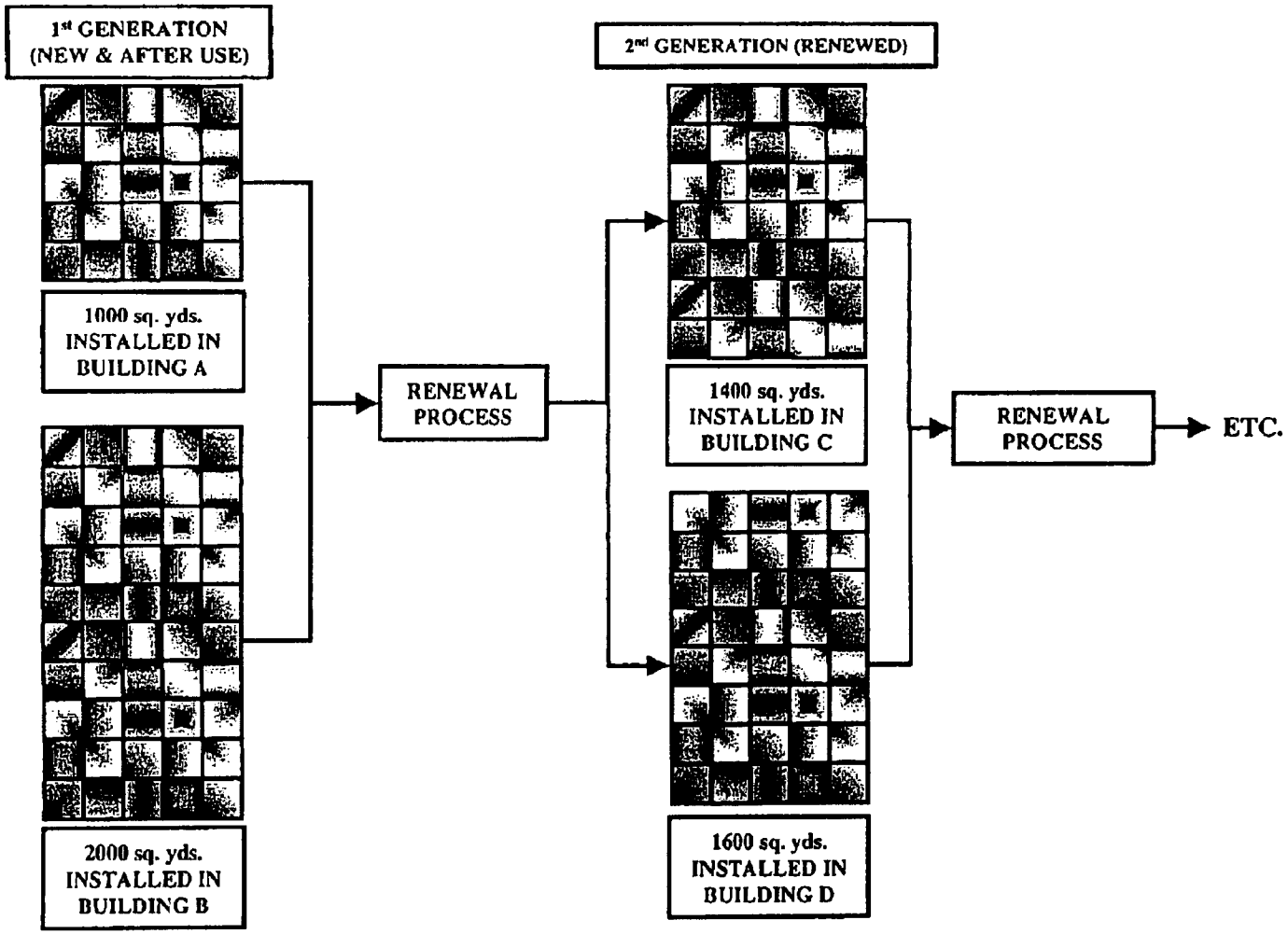
FIG. 3 is a schematic flow diagram of the life cycle of the random pattern/design/color/shade carpet tile of the present invention (such as shown in FIG. 1A) from use as a new (or used) product through use as a renewed product. The process includes the steps of installation, use, removal, renewal, installation, use, removal, renewal, installation, etc. without the need for mapping or shade sorting.
Figures 6A, 6B:
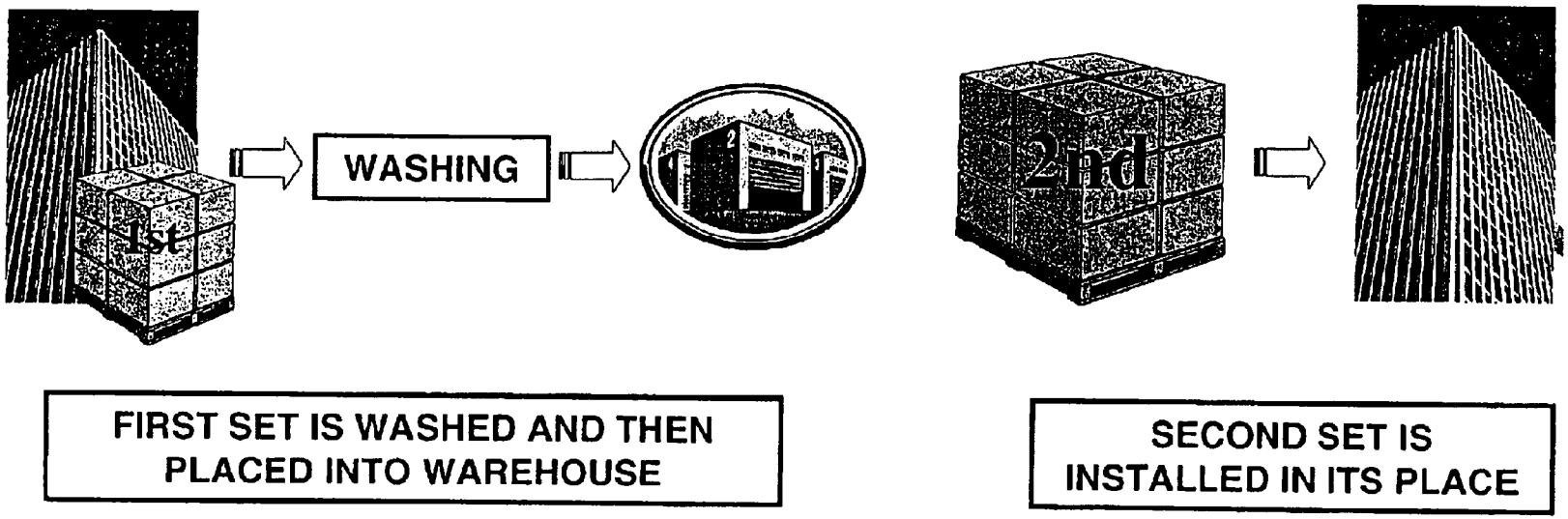

In contrast to such a typical tile renewal process, at least one embodiment of the present invention provides for almost complete renewal and reuse of used carpet tile. With reference to FIG. 3 of the drawings and in accordance with a particular example of the present invention there is shown 1,000 sq. yards of a random assortment of carpet tile patterns, designs or shades installed in Building A and 2,000 sq. yards of such carpet installed in Building B, these tiles are removed and renewed and reinstalled or used as 1,400 sq. yards installed in Building C and 1,600 sq. yards installed in Building D. These renewed and reinstalled tiles may be removed and renewed again until such time as the carpet tile have reached their maximum life and must be discarded or destructively recycled. Wear and staining after use and shade changes caused by processing do not matter in the process of the present invention since patterning is random (the carpet tiles are installed in random fashion). Thus, there is no requirement for shade sorting before and after renewal. There may be a limited amount of tile which cannot be reused due to severe damage to such tile such as holes, tears, or small pieces. It is preferred that the tiles be complete carpet tile to be renewed and reused.

All of the renewable tiles from the previous installation or installations can be combined into one generational lot for use in all areas of the next installation or installations. No mapping is required, no shade sorting is required, and tiles are not separated into shade lots. Hence, inventory is turned over quickly and no small lots of renewed tiles exist, need to be tracked, stored, or the like.

Also, with respect to FIG. 3, the figure illustrates the life cycle of the invention from use as a new product through use as a renewed product. Further, with respect to the first Renewal Process of FIG. 3, note that wear and staining after use and shade changes from processing do not matter since patterning is random—thus, no shade sorting before and after renewal is necessary. With respect to the second Renewal Process of FIG. 3, note that all tile from previous installations can be combined into one generational lot for use in all areas of the next installation—no mapping is required, and that inventory is turned over quickly and no small lots exist.

On average, approximately 20 million square yards of carpet tile is produced and sold in Japan each year. Very little of this yearly production volume is renewed or recycled. Used tiles are disposed of in landfills.

The need and appeal for recycled or renewed products has recently increased in Japan, Europe, the U.S., and the like. Governmental focus on recycling is increasing as well. In the year 2000, over 95% of the carpet tile sold in Japan was solid color tile, and less than 5% was multi-colored graphic carpet tile (patterned or graphic tufted). Carpet tile that is one solid color or one repeating pattern is susceptible to shading differences after carpet tile renewal.

The renewal of conventional solid color tile or conventional patterned carpet tile (with a single repeating pattern) is a complicated process with high cost, high waste rates, and high inventory requirements.

With respect to a carpet tile leasing process incorporating renewal of leased conventional patterned carpet tile or conventional solid color carpet tile, two sets of carpet tile are manufactured for a single installation. One complete set is manufactured for immediate installation and a second set is manufactured and stored in a warehouse (FIGS. 4A and 4B). Before washing or renewing of the leased carpet tile, a map of the installation must be made (FIG. 5A). After washing, each tile must be replaced in its original location because of differences in wear and soiling over time. Hence, each tile is marked with its map number as shown in FIG. 5B.

After mapping, the first set of tile is taken up, then washed and stored until it is needed again. The second set of tile is taken from the warehouse and installed at the job site or installation. Then, the cycle is repeated.

Because conventional carpet tiles are either a solid color or a single repeating pattern, two complete sets of conventional tile must be made for each leased carpet tile installation. This is not only expensive, but complicated and cumbersome. The mapping of each tile, marking of each tile, and insuring that each tile is placed back its original location is time consuming and prone to error.

The reason that conventional solid color or single pattern carpet tile requires a second set of leased tile is that conventional carpet tile are susceptible to shading problems. Shading variations are caused by uneven soiling, wear over time, and by the renewal process.

Shading problems require mapping of the installation and numbering of the tiles before each renewal process. Overall, leasing conventional carpet tile is a complex and expensive process.

Also, with respect to FIGS. 4A, 4B, 5A, 5B, 6A, and 6B, these figures relate to washing of leased carpet.

With reference again to FIGS. 2A and 2B, renewal of purchased conventional carpet tile, like leased tile, is also complicated and requires complex sorting and handling work both before and after renewing or renewal.

In accordance with the present invention, the limitations or drawbacks of other, prior, typical, or conventional renewal processes or methods are addressed, eliminated, or at least reduced by implementation of a method of tile renewal that utilizes substantially 100% of used carpet tile that can be renewed as opposed to using only a portion of the tile material when recycling, that eliminates shade sorting before and after renewal, that eliminates the need to plan installations after each renewal sequence, that minimizes the number of lots in inventory, that provides a renewed tile which is attractive and useful, and that results in a tile that can easily be leased in addition to being sold.

With reference again to FIGS. 1A and 1B of the drawings, in a particular embodiment of the present invention, each pattern of the 36 individual original patterns and/or colors is a gradation of color, contains cool and warm colors alike of various shades, and has a coloration which allows better coordination with a range of desks, chairs, and partitions within an installation.

In the random installation (FIG. 1B) of the present invention, no two tiles of the same pattern are installed adjacently. The unique method of patterning and installation of the product eliminates the need for shade sorting before and after renewal, and permits the ability to replace a damaged or severely stained tile without truly having to worry about tile-to-tile shading between the old and new tiles.

In accordance with the present invention, the first generation may be totally new carpet tile, or may be a mixture of new and used carpet tile. The second and third generations are preferably renewed carpet tiles but may include new carpet tile as needed or desired.

Figure 7:
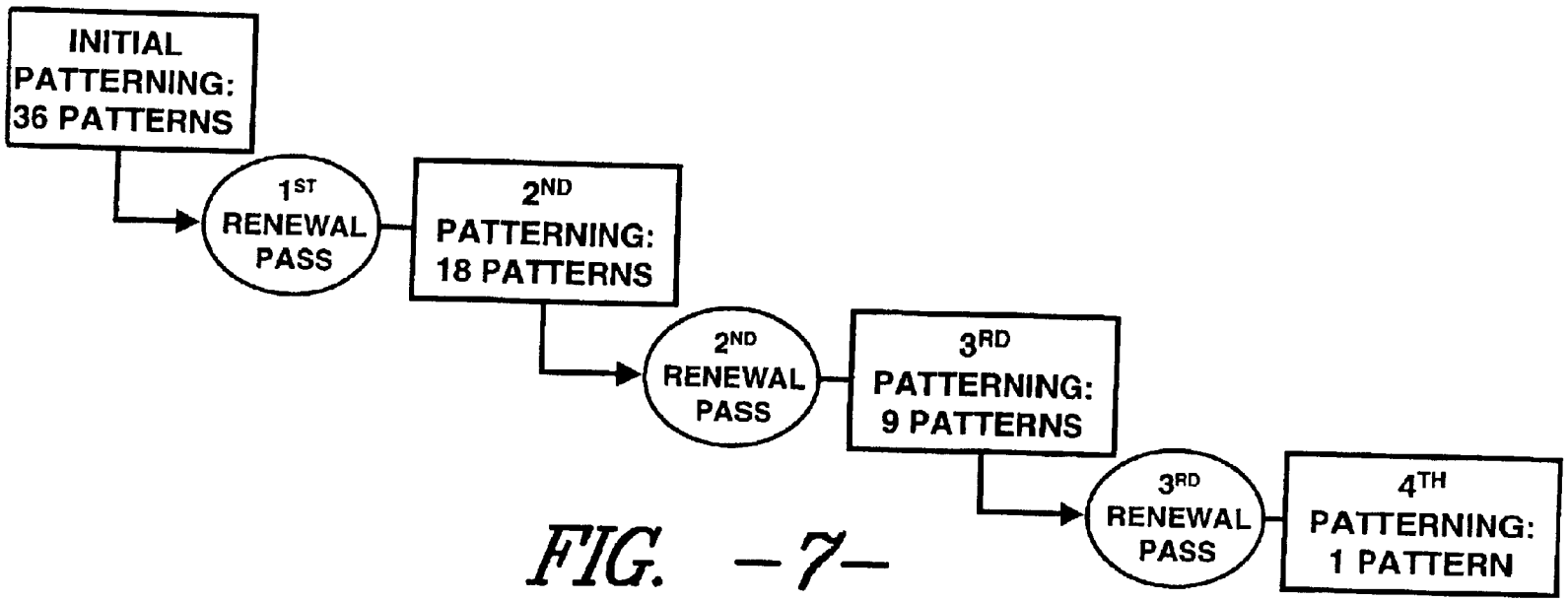
FIG. 7 is a schematic block diagram of an improved renewal process in accordance with one embodiment of the present invention.
Figure 8:
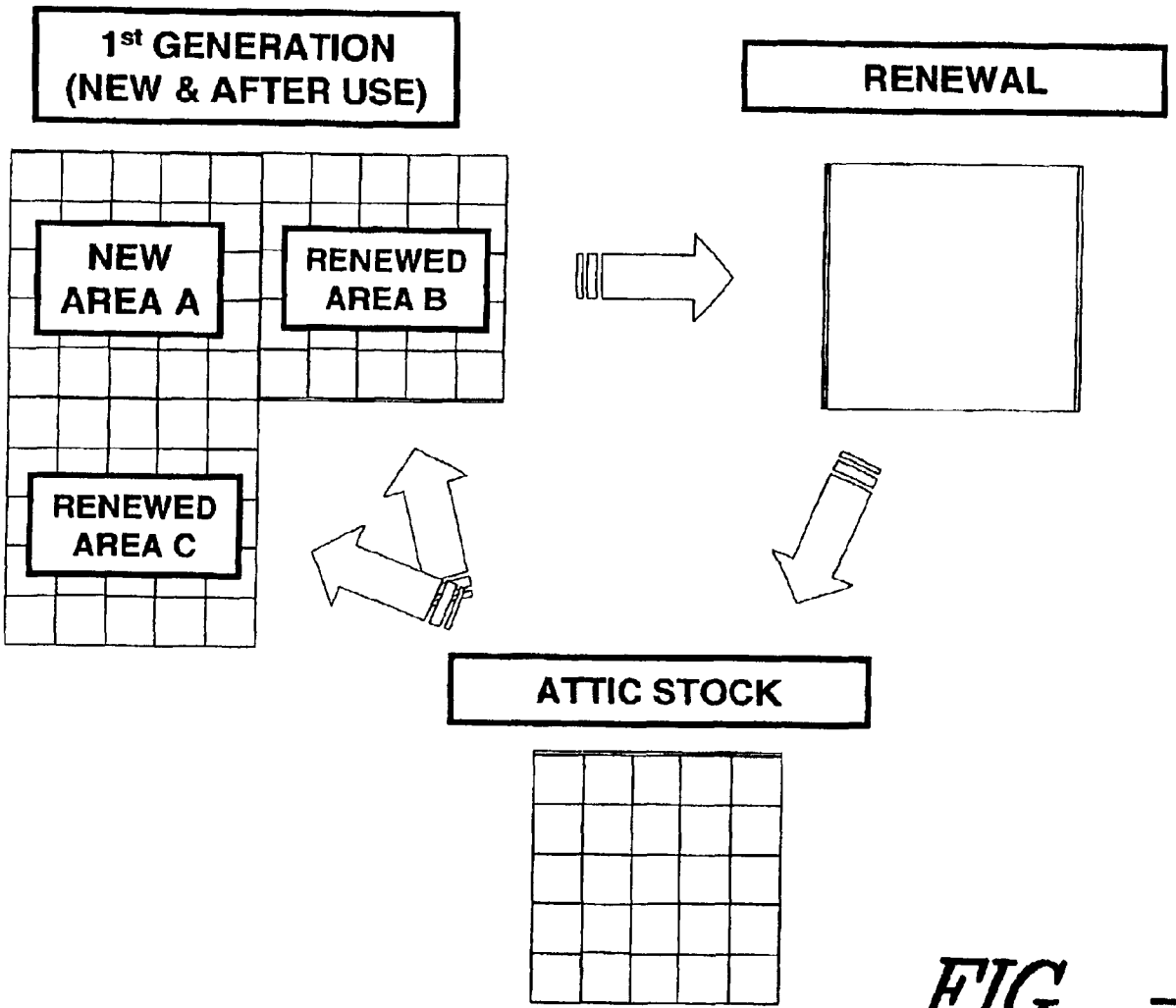
FIG. 8 is a schematic illustration of a small job renewal process in accordance with another embodiment of the present invention.

With reference to FIG. 7 of the drawings, the renewal process of the present invention may include the Earth Square® renewal (cleaning and surface retexturing), and over-patterning process of Milliken & Company. Each patterning pass may include fewer and fewer patterns and a small amount of dye applied to the tile. The patterns may be developed to keep the tile looking attractive after each patterning pass and not muddled.

As mentioned above, if the carpet tile were a conventional solid color tile, such as a light color solid color carpet tile, the first patterning or printing of the tile may occur during the first renewal process (after the first renewal pass).

In accordance with another aspect of the present invention, a small job or installation may be handled by a particular renewal process or cycle wherein certain areas of a job site or installation are renewed or new carpet tile areas and renewed carpet tiles are kept in attic stock or basement storage to be used as needed. For example, certain areas may be renewed in sequence rather than removal and renewal of the entire location.

Selected advantages of the new pattern method or process, installation, renewing, and/or recycling of the present invention include:

The tile carpet is a product that can be renewed and reused.

Eliminates manual shade sorting of tile before and after renewal.

Eliminates mapping and planning of installations with respect to tile-to-tile shading variations.

Customers with only one building and use the product.

Minimizes inventory cost. Large "generational" inventory lots turn over quickly as opposed to small lots.

Allows larger range of color content that allows easier coordination with desks, chairs, and partitions.

Allows the replacement of a damaged or severely stained old tile with a new tile without having to worry about tile-to-tile shading.

Overall cost of renewing carpet tile is less than the cost of manufacturing new carpet tile for the same installation.

This tile product can be sold direct or leased.

If leased, does not require second set of inventory to be manufactured.

Leased tile is simply picked up for cleaning and replacement tile is installed without ever having to map the installation.

When leasing the tile as opposed to owning the tile, the end user can count the cost of leasing as a business expense rather than an owned asset that may carry a tax liability.

The renewed tile reduces overall waste to landfill or incinerators or the cost of destructive recycling.

The following are steps of an exemplary renewal, refurbishment, or reproducing/recoloring method. Such a method may also be referred to as a non-destructive recycling method.

(1) At the site for flooring, for instance, in a building, carpet titles in use are successively removed from the floor, for example, in units of a group of carpet titles laid on each floor, while avoiding as much as possible damage to the carpet tiles.

(2) The removed carpet tiles are sorted (pre-sorted) into reproducible ones and non-reproducible ones, according to, e.g. the presence/absence of severe damage. Essentially, this choosing step can be described as sorting out tiles that can not be reused due to physical damage or defects, for example, as cuts, holes, torn carpet, separated backing or small pieces cut to match or fit to a room. Even non-skilled persons can sort the carpet tiles by using, for instance, samples indicating limits. The carpet tiles, which have been determined to be non-reproducible, are discarded or destructively recycled.

(3) The carpet tiles, which have been determined to be reproducible, are kept, for example, in an empty space, such as a basement parking lot, in the building in which the carpet tiles are being exchanged, until the number of such carpet tiles reaches a predetermined value (e.g. the number corresponding to a maximum load of a truck for transportation).

(4) The predetermined number of carpet tiles are brought to a renewal or reproduction factory by a transportation means such as a truck.

(5) The carpet tiles brought to the reproduction factory are preferably kept in a dry place or a place with low humidity and, immediately thereafter, subjected to a washing process. Also, the carpet tiles may be steam pre-bulked prior to washing using a steam chamber to steam and pre-bulk the yarn (pile).

Figure 10:
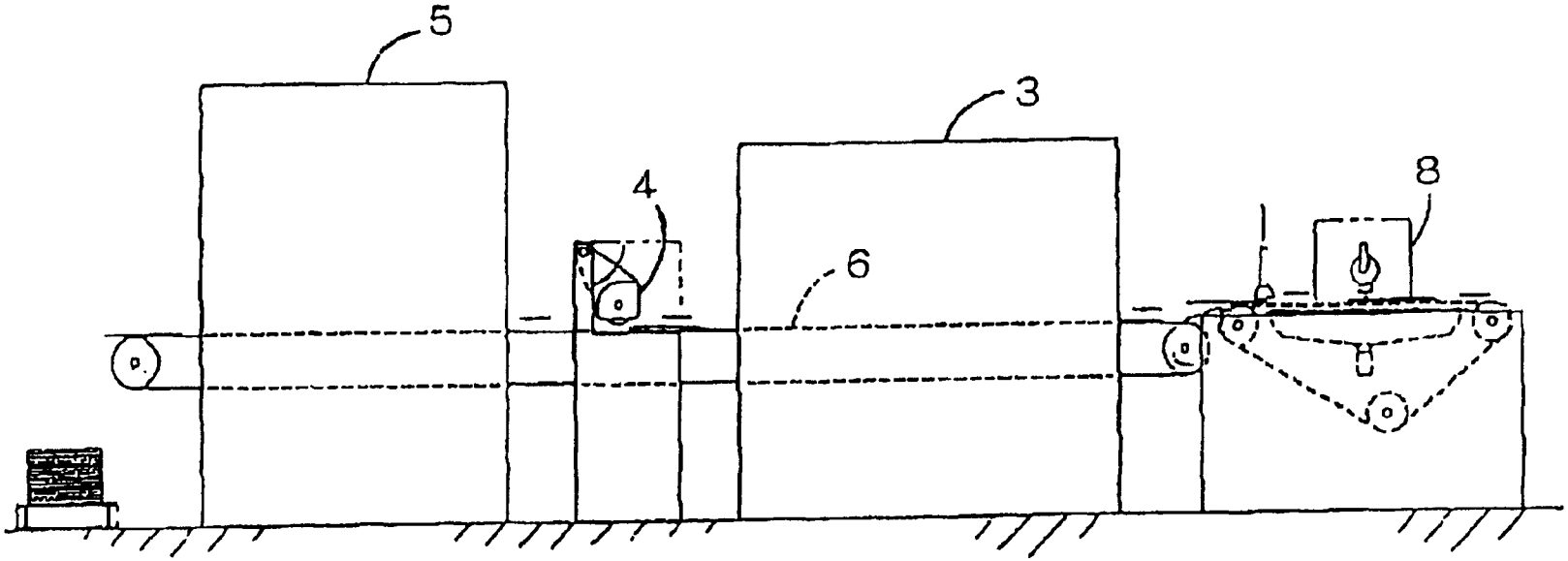
FIG. 10 is a schematic side view illustration of a carpet tile reproducing apparatus.

(6) In the washing process, preferably a high-pressure washing apparatus denoted by numeral 8 in FIG. 10 (e.g. an apparatus disclosed, for example, in Jpn. Pat. Appln. KOKAI Publication No. 6198265 or U.S. Pat. Nos. 5,381,592 and 5,457,845 hereby incorporated by reference herein or a spray nozzle type high pressure washing device) is used. In the high-pressure washing apparatus 8, a pressurized washing liquid (which may also be heated) is jetted on the carpet tiles which are passed underneath while being conveyed over a conveyor 6. Thus, the carpet tiles are cleaned. With such cleaning, dirt, dust, mud, sand, and part of stain on the carpet tile is eliminated. In addition, a retexturing process for removing entangling of weaving yarns (piles) and raising them is performed. The high-pressure washing apparatus has a dryer or drying machine 3 for drying the cleaned carpet tiles, a cutting or shearing machine 4 (not always required) for making the height of piles uniform, a printing, dyeing or coloring machine 5 for coloring carpet tiles, and the conveyor 6 for successively conveying the carpet tiles.

In accordance with one embodiment of the present invention, universal spray nozzles are used to project a washing fluid such as high pressure water at the pile side of the used carpet. The high pressure water may be at a pressure of about 100–3,000, preferably 200–2,000 pounds per square inch (psi) and at a flow rate of about 30–200, preferably 30–65 gallons per minute (gpm), with the spray nozzles moved or indexed across the face of the used carpet or with the used carpet moved or indexed under one or more spray nozzles. Also, a germicidal, anti-microbial, anti-fungal, and/or anti-bacterial agent or agents can be added to the washing liquid.

(7) In order to enhance the clearness of the reproduced carpet tiles which are to be subjected to a recoloring process in a subsequent step (13), the washed/reproduced carpet tiles are subjected to a coating or applying process wherein the carpet tiles are coated or treated with a cationic, water soluble, polymeric chemical agent or compound or a chemical agent for preventing blurring of a coloring agent. This coating process is performed, for example, using chemical agents to enhance dyeing or coloring and such properties as to prevent diffusion of coloring agent. The chemical agents facilitate uniform dyeing and pattern clarity by controlling the rate of dye uptake on the pile yarns.

(8) Following the coating process, the carpet tiles are dried, (9) Using a computer, etc., such a pattern, design, shade and/or color as to make adjacent tiles different is selected.

(10) Printing, coloring, or reprinting is performed by using a computer-controlled printing, dyeing, or coloring machine. In the computer control, for example, image information prepared by a design computer is digitized, this information is delivered to the coloring machine 5 shown in FIG. 10, and the coloring machine 5 is operated.

(11) After re-printing, the dye or color is fixed on the carpet tile and the carpet tile is washed, a surface treatment process is performed to coat the carpet tile with a stain-proof agent for preventing the carpet tile from being stained, an antistatic agent for suppressing static electricity, and/or a germicidal-effect agent having a germicidal effect, then, the carpet tile is dried.

(12) A problem to be solved in connection with the reproduced carpet tile is that the carpet tile in use may be curled in the reproducing step. In order to solve this problem, the carpet tile is forcibly bent in the opposite direction by means of, e.g. a bending machine.

(13) The piles on the edge portion of the tile may have fallen due to the high-pressure washing. In order to solve this problem, fallen piles, which are conspicuous, are cut or trimmed by a machine such as an edge trimmer or shear. Also, the face pile may be sheared to give the tile a better appearance or to make the pile height uniform.

(14) The reproduced carpet tiles are temporarily kept and then shipped.

Some of the steps of the above-described methods can be omitted or the order of steps can be changed.

In accordance with another embodiment, washed used carpet tile are brought to the reproducing factory and treated and then either picked up by the customer or shipped to the customer.

The reproducing or renewal process may also include a back coating step and drying step wherein the back surface of the carpet tile is coated or covered with a thin layer of a, for example, coating material to, for example, give the back of the tile a new tile look and smooth appearance. This back coating can be done prior to or following recoloring.

Another problem to be solved with used carpet tile may be related to adhesive residue that may stick to the original backing during removal in the many cases where adhesives were used in the original installation. Back coating or removal of the adhesive residue may be necessary for proper and smooth processing during the patterning step. The backcoating step of the present invention may be used to solve this problem while at the same time giving the tile a "new" appearance.

In accordance with one embodiment of the present invention, the pile face yarns of used carpet tile, or other flooring, is cleaned and re-textured using the above described methods and apparatus. After drying in a conventional oven, a thin layer of approximately 2 mm of modified acrylic material is applied to the back surface of the refurbished carpet tile using roll applicators, thereby creating a new appearance, a new coated product, and refurbishing the back of the used tile.

The tile is subsequently dried in an oven to remove water and cross-link the acrylic polymer. The acrylic-coating layer when cross-linked, bonds to the original tile back and is highly resistant to chemical plasticizers commonly used for PVC backed carpet tile. The new backing layer forms a protective or blocking layer against plasticizer migration, thereby providing unique product attributes for refurbished carpet tile. Tiles may be re-colored using a textile dyeing or pattern process without adversely effecting the renewed tile back.

In accordance with another embodiment of the present invention, the used carpet tile is steamed and the face yarns pre-bulked prior to using the above mentioned methods and apparatus to clean and re-texture the yarns. After washing, the re-textured yarns are chemically treated by applying a cationic, water soluble, polymeric organic compound and dried in an oven to uniform moisture content. After drying, the surface pile yarn is sheared to a uniform and level height, and the tile edges are trimmed or sheared to make the tile square. A pattern jet dye machine is used to apply new dye colors or pattern. The tile is next steamed, washed and dried using conventional methods. Thereafter, the back of the title may be coated as described above.

Figure 9:
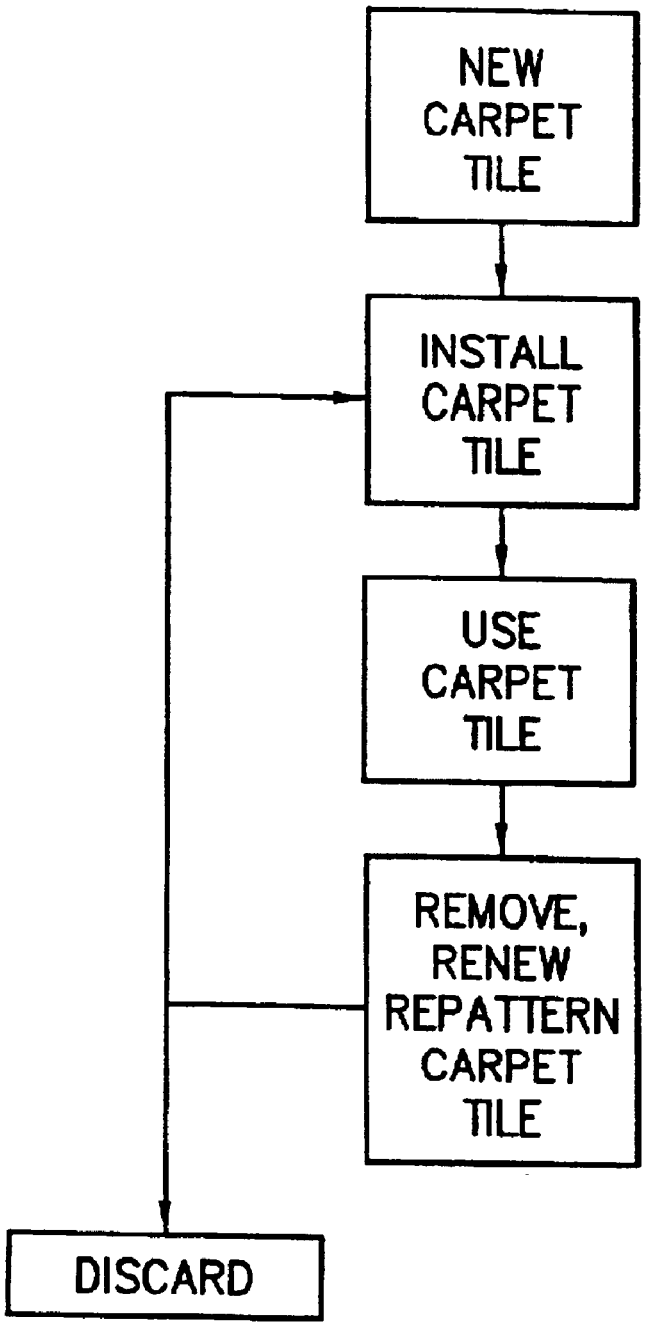
FIG. 9 is a block diagram representing another exemplary process of the present invention.

As shown in FIG. 9 and in accordance with another embodiment of the present invention, there is provided a multi-year, multi-cycle renewable flooring system, wherein carpet is laid down first as new carpet tiles, used for a time, then removed, renewed (cleaned, treated, patterned), reinstalled, used for another time or cycle, removed, renewed (cleaned, treated, patterned), reinstalled, used for yet another time or cycle, removed, renewed (cleaned, treated, patterned), reinstalled, and used for still yet another time or cycle, For example, one could sell or lease renewable carpet tile as 30 year or three generation flooring (first generation-new, second generation-renewed, third generation-renewed again) with each generation being, for example, 5–10 years. After the third generation, the carpet can be renewed again or disposed of or destructively recycled.

Due to the high cost of disposing of or destructively recycling (grinding and treating) carpet by conventional means, the present invention provides for the marketing, lease, and/or sale of carpet as renewable carpet which can be renewed and reused instead of disposed of in a landfill or destructively recycled by another move expensive process. The present invention provides for the saving of the existing value in used carpet (fiber, such as nylon, and backing), rather than destructive recycling or land filling of the used carpet.

Also, in accordance with another aspect of the present invention, there is provided a price blended or lower cost carpet replacement system. For example, if about 95% or more of the used carpet tile at a location can be removed, renewed (cleaned, treated, patterned), and reinstalled back at the same or a different location, and the price of renewed carpet is less than that of new carpet, then the replacement cost of the carpet of the location can be price blended and reduced by replacing about 5% or less of the carpet with new carpet and about 95% or more (the remainder) with renewed carpet. It is difficult to renew 100% of the used carpet because some of the used carpet is badly damaged, stained, cut, or pieces of carpet tile rather than whole carpet tile. It is preferred to renew complete or whole carpet tiles in order to simplify and facilitate the washing, treating, patterning or dyeing process.

Renewing, washing, and/or recycling of used carpet tiles is provided. In accordance with one embodiment, carpet tiles are purchased or leased and installed with adjacent tiles being of a different pattern, design, color, shade, and/or the like so that no two identical tiles abut one another. This method of patterning and installing carpet tiles can eliminate the need for shade sorting and site mapping. Also, this method permits the ability to replace one or more damaged or severely stained tiles with new or renewed tiles and without worrying about tile-to-tile shading. The renewed carpet tiles are washed with a high-pressure fluid, and entangling of piles is removed and piles raised.

The embodiments of the present invention have been described above with reference to the accompanying drawings. This invention, however, is not limited to such embodiments, and various embodiments and modifications can be made without departing from the spirit of the claimed invention.

What we claim is:

1. A method of installing and recycling carpet tiles in at least one area in which a plurality of carpet tiles are laid, the method comprising the steps of:

installing a plurality of carpet tiles having different patterns, colors, shades, designs or combinations thereof in a substantially random pattern in at least a first area to define a carpet installation incorporating said carpet tiles, wherein the installation incorporates tiles with at least 9 different patterns, colors, shades, designs or combinations thereof with all adjacent tiles in the installation being of a different pattem, color, shade, design, or combination thereof such that no carpet tile installed in the first area is in contacting relation with any other tile which is not of a different pattern, color, shade, design, or combination thereof;

removing carpet tiles from first said area;

installing replacement carpet tiles in said first area from which the carpet tiles have been removed in a substantially random pattern to define a replacement installation, wherein the replacement installation incorporates tiles with at least 9 different patterns, colors, shades, designs or combinations thereof with all adjacent tiles in the replacement installation being of a different pattern, color, shade, design, or combination thereof such that no carpet tile in the replacement installation is in contacting relation with any other tile which is not of a different pattern, color, shade, design, or combination thereof; and, renewing the removed carpet tiles.

2. The method of claim 1, further comprising the steps of:

removing carpet tiles in a second area, which are to be subsequently renewed; and installing at least a portion of the first removed and renewed carpet tiles on the second area from which the carpet tiles were subsequently removed with all adjacent tiles being of a different pattern, color, shade, design, or combination thereof such that no carpet tile installed in the second area is in contacting relation with any other tile which is not of a different pattern, color, shade, design, or combination thereof.

3. The method of claim 1, wherein said renewing step includes:

a washing step of jetting a fluid onto the removed carpet tiles, thereby to perform cleaning for cleaning dirt and stain on the carpet tiles and to perform retexturing, thus forming cleaned and treated carpet tiles.

4. The method of claim 3, wherein said renewing step further includes:

a recoloring step of recoloring at least a portion of the cleaned and treated carpet tiles with a pattern, design, shade, color, or combinations thereof.

5. The method of claim 1, wherein said tiles in said first area include at least one of new tiles and renewed tiles.

6. The method of claim 1, wherein said tiles in said first area are made up of at least 16 different patterns, colors, designs, shades, or combinations thereof.

7. The method of claim 1, wherein said tiles in said first area are made up of at least 25 different patterns, colors, designs, shades, or combinations thereof.

8. The method of claim 1, wherein said tiles in said first area are made up of at least 36 different patterns, colors, designs, shades, or combinations thereof.

9. The method of claim 2, wherein said tiles in said second area are made up of at least 9 different patterns, colors, designs, shades, or combinations thereof.

10. The method of claim 9, wherein said tiles in said second area are made up of at least sixteen different patterns, colors, designs, shades, or combinations thereof.

11. The method of claim 9, wherein said tiles in said second area are made up of at least twenty-five different patterns, colors, designs, shades, or combinations thereof.

12. The method of claim 9, wherein said tiles in said second area are made up of at least thirty-six different patterns, colors, designs, shades, or combinations thereof.

* * * * *